US008641211B2

(12) United States Patent
Park

(10) Patent No.: US 8,641,211 B2
(45) Date of Patent: Feb. 4, 2014

(54) ROAD DELINEATOR

(76) Inventor: Joo Min Park, Busan (KR)

( * ) Notice: Subject to any disclaimer, the term of this patent is extended or adjusted under 35 U.S.C. 154(b) by 168 days.

(21) Appl. No.: 13/392,007

(22) PCT Filed: Jun. 24, 2010

(86) PCT No.: PCT/KR2010/004093
§ 371 (c)(1),
(2), (4) Date: Feb. 23, 2012

(87) PCT Pub. No.: WO2010/151056
PCT Pub. Date: Dec. 29, 2010

(65) Prior Publication Data

US 2012/0162767 A1 Jun. 28, 2012

(30) Foreign Application Priority Data

Jun. 25, 2009 (KR) ..... 10-2009-0056875

(51) Int. Cl.
*G02B 5/12* (2006.01)

(52) U.S. Cl.
USPC ..... 359/551

(58) Field of Classification Search
USPC ..... 359/531–532, 547, 551–553
See application file for complete search history.

(56) References Cited

U.S. PATENT DOCUMENTS

| | | | | | |
|---|---|---|---|---|---|
| 1,333,551 | A | * | 3/1920 | Larkin | 359/547 |
| 4,717,281 | A | * | 1/1988 | Shepherd et al. | 404/16 |
| 4,875,798 | A | * | 10/1989 | May | 404/12 |
| 5,002,424 | A | * | 3/1991 | Hedgewick | 404/14 |
| 5,022,739 | A | * | 6/1991 | Bennett et al. | 359/529 |
| 5,680,033 | A | * | 10/1997 | Cha | 359/542 |
| 6,168,276 | B1 | * | 1/2001 | Weid | 359/547 |

FOREIGN PATENT DOCUMENTS

KR 10-2009-0112100 A 10/2009

* cited by examiner

*Primary Examiner* — Jennifer L. Doak
(74) *Attorney, Agent, or Firm* — Sherr & Jiang, PLLC

(57) ABSTRACT

Disclosure relates to a road delineator installed at a road facility, such as a guardrail, to reflect light from car headlights, and more specifically, an angle adjustment part of the delineator having a cover hinged to a stationary body has a simple structure to facilitate angle adjustment of the hinged cover, the head of an anchor bolt is easily inserted into the stationary body that is installed at the road facility yet the anchor bolt is not easily separated from the stationary body once the head thereof sits in the stationary body, such that the delineator at the road facility can be installed conveniently, and a backing metal is embedded in the bottom plate of the stationary body to protect the bottom plate of the stationary body made of a synthetic resin material from damages caused by the head of the anchor bolt when the anchor bolt is forcedly fastened to the road facility.

2 Claims, 6 Drawing Sheets

ROAD DELINEATOR

CROSS REFERENCE TO PRIOR APPLICATIONS

This application is a National Stage Patent Application of PCT International Patent Application No. PCT/KR2010/004093 (filed on Jun. 24, 2010) under 35 U.S.C. §371, which claims priority to Korean Patent Application No. 10-2009-0056875 (filed on Jun. 25, 2009), which are all hereby incorporated by reference in their entirety.

TECHNICAL FIELD

The present invention relates to a road delineator installed at a road facility, such as a guardrail, installed, on a road to reflect light from car headlights. More specifically, the present invention relates to a road delineator, which has a simple structure of an angle adjustment part of the delineator having a hinged cover hinged to a stationary body to facilitate angle adjustment of the hinged cover, in which a head of an anchor bolt is easily inserted inside the stationary body installed at a road facility but the anchor bolt is not easily separated from the stationary body once the head of the anchor bolt sits in the stationary body, such that the delineator can be conveniently installed at the road facility, and which is formed with a backing metal embedded in a bottom plate of the stationary body so as to protect the bottom plate of the stationary body made of a synthetic resin material from damages caused by the head of the anchor bolt when the anchor bolt is forcedly fastened to the road facility.

BACKGROUND ART

The applicant of the present invention previously filed the patent application related to a hinged delineator for a road facility under Patent Application No. 10-2008-0037794, in which a delineator is installed at a road facility such that one side of the delineator is hinged in a shape of a sector, a hinged cover formed with a reflector attached to an outside surface thereof adjusts an angle of inclination serving as an angle adjustment part, to adjust the angle of inclination of the hinged cover and install the delineator in accordance with a degree of the curve of a road, thereby accurately indicating a position of the road facility even in a curve road.

Further, the slantingly installed hinged cover in a shape of a sector is elastically installed such that the hinged cover is restored to its original position even after being pressed by elasticity of a spring. As a result, even when a vehicle contacts the delineator or the road facility at which the delineator is installed so that the hinged cover is pressed, the hinged cover is returned to its original angle with the adjusted angle of inclination by the elasticity of the spring, thereby accurately indicating the position of the road facility all the time.

However, the prior patent application has a problem in that it is very troublesome and inconvenient to assemble a stationary body with the hinged cover, install the delineator including the assembled stationary body and hinged cover at a road facility, such as a guardrail, and adjust an angle of the hinged cover in the stationary body, and in that a bottom plate made of a synthetic resin material is damaged by strong fastening force generated during the fastening of the bottom plate of the stationary body by a head of a bolt when the bolt, of which the head is inserted inside of the stationary body, is forcedly fastened in order to install the delineator at the road facility.

According to the assembling of the hinged cover with the stationary body, a screw of an angle adjustment is outwardly passed through an elongated slot of the hinged cover, and the outwardly passed screw is then first semi-fastened with a locking nut and then the stationary body is assembled with the hinged cover while a holding pin of the angle adjustment part protruding inward from the hinged cover is inserted into a cut-out portion of the stationary body and a spring and the hinge pin are inserted into the stationary body and a hinge coupling part of the hinged cover. However, the above assembling operation is very troublesome and inconvenient.

Further, when the delineator having the assembled stationary body and hinged cover is desired to be installed at the road facility through inserting the head of the bolt into the stationary body through the cut-out portion and then fastening the bolt to the road facility, the bolt, of which the head is inserted inside the delineator, is shaken by an interval between the stationary body and the hinged cover, so the installation of the delineator at the road facility is very inconvenient and troublesome.

Further, in a case of attempting to adjust the angle of the hinged cover in the stationary body, it is necessary to release the locking nut first semi-fastened with the elongated slot of the hinged cover from the screw of the angle adjustment part and then fasten the locking nut while moving a height adjustment part upward and downward to a required position. However, only the screw of the height adjustment part is exposed to the outside and the remaining flange unit and holding pin unit are inserted inside the delineator, so that the locking nut and the height adjustment part rotate with no traction when the locking nut is rotated, and thus there occurs a serious drawback of failing to adjust the angle of the hinged cover.

DISCLOSURE

Technical Problem

Accordingly, the present invention has been made to solve the above-mentioned problems occurring in the prior art, and a technical aspect of the present invention is to provide a road delineator, which simplifies a structure of an angle adjustment part of a delineator having a hinged cover hinged to a stationary body, thereby achieving easy assembling of the present invention and easy adjustment of an angle of the hinged cover, enables a head of an anchor bolt to be easily inserted inside the stationary body installed at a road facility and prevents the anchor bolt from being separated from the stationary body once the head of the anchor bolt is fitted to the stationary body, thereby achieving the simple installation of the delineator at the road facility, and prevents a bottom plate of the stationary body made of a synthetic resin material from being damaged by the head of the anchor bolt when the anchor bolt is forcedly fastened to the road facility through embedding a backing metal in the bottom plate of the stationary body.

Technical Solution

In accordance with an aspect of the present invention, there is provided a road delineator including: a stationary body installed at a road facility by means of an anchor bolt; and a hinged cover formed with a reflector attached to a top surface thereof, the hinged cover covering an outside of the stationary body in a hinge-like manner such that an angle of inclination thereof is adjustable, wherein the stationary body is shaped like a sectorial box with an opened top part and includes a U-shaped cut-out portion formed with a backing metal embedded in a bottom plate thereof and formed in such a manner that a front side thereof is open, a screw protruding from an external surface of an upper side of a front plate, a bolt head insert formed by tearing off a corner of a front lower side of the stationary body to communicate with the U-shaped cut-out portion, and bolt head holding portions into which both ends of a head of an anchor bolt are inserted to be held, the bolt head holding portions being formed at predetermined positions of both side plates, and the hinged cover is shaped like a sectorial box with an opened bottom part, covers a top part of the stationary body, and is formed with an elongated slot through which the screw of the stationary body is inserted and guided up and down at a front plate thereof, and a locking nut is fastened with the screw protruding outward from the elongated slot.

ADVANTAGEOUS EFFECTS

Accordingly, the present invention has an effect of achieving easy assembling of the road delineator of the present invention and easy adjustment of an angle of the hinged cover through simplifying the structure of the angle adjustment part of the delineator having the binged cover hinged to the stationary body, achieving the simple installation of the delineator at the road facility because a head of an anchor bolt may be easily inserted inside the stationary body installed at a road facility and the anchor bolt may be prevented from being separated from the stationary body once the head of the anchor bolt is fitted to the stationary body, and preventing a bottom plate of the stationary body made of a synthetic resin material from being damaged by the head of the anchor bolt when the anchor bolt is forcedly fastened to the road facility through embedding a backing metal in the bottom plate of the stationary body.

BRIEF DESCRIPTION OF THE DRAWINGS

The above and other aspects, features and advantages of the present invention will be more apparent from the following detailed description taken in conjunction with the accompanying drawings, in which.

DESCRIPTION OF REFERENCE NUMBER OF MAIN ELEMENTS IN DRAWINGS

| | |
|---|---|
| 1: delineator | 2: road facility |
| 3: locking screw | 10: hinged cover |
| 11: reflector | 12: hinge pin hole |
| 13: elongated slot | 14: stationary body |
| 20: stationary body | 21: bottom plate |

-continued

| | |
|---|---|
| 22: side plate | 23: front plate |
| 24: U-shaped cut-out portion | 25: bolt head insert |
| 26: backing metal | 27: screw |
| 28: hinge protrusion | |
| 29: bolt head holding portion | 30: anchor bolt |
| 31: head | 32: bolt |

BEST MODE

Mode for Invention

Hereinafter, a road delineator according to the present invention will be described with reference to the accompanying drawings FIGS. 1 to 7.

Figure 1:
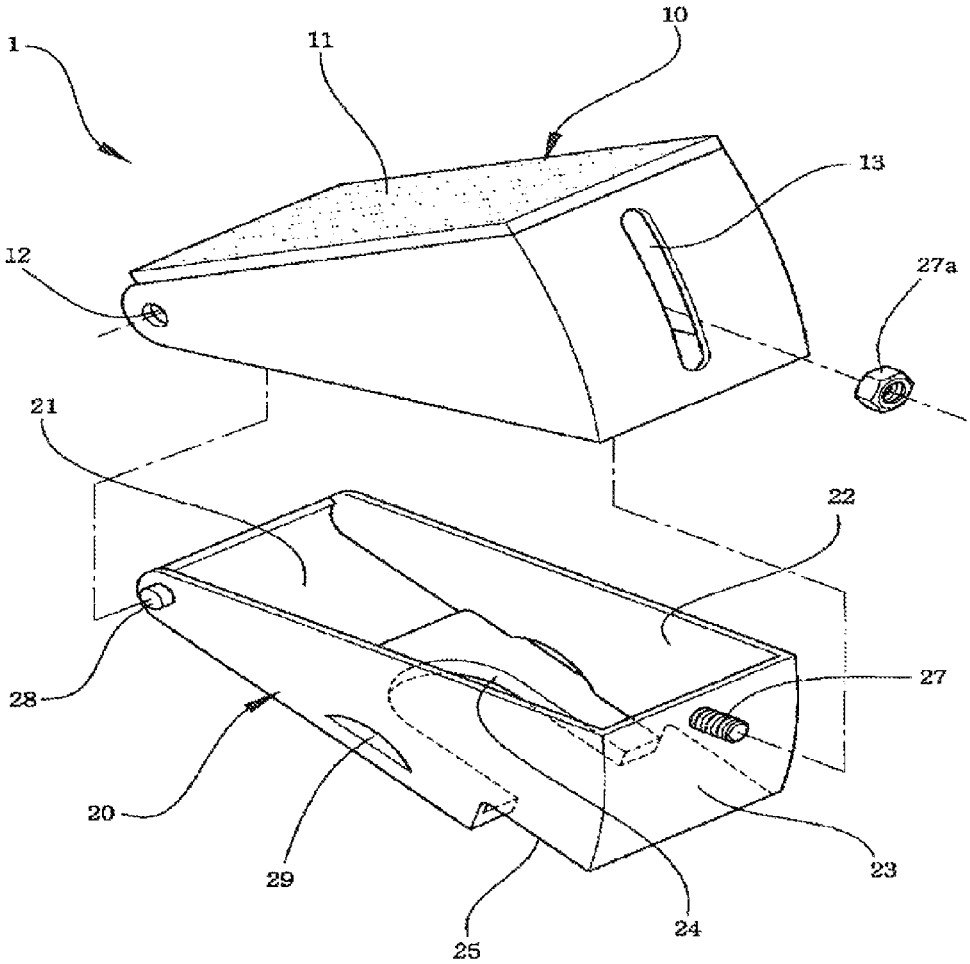
FIG. 1 is an exploded perspective view illustrating the present invention.
Figure 2:
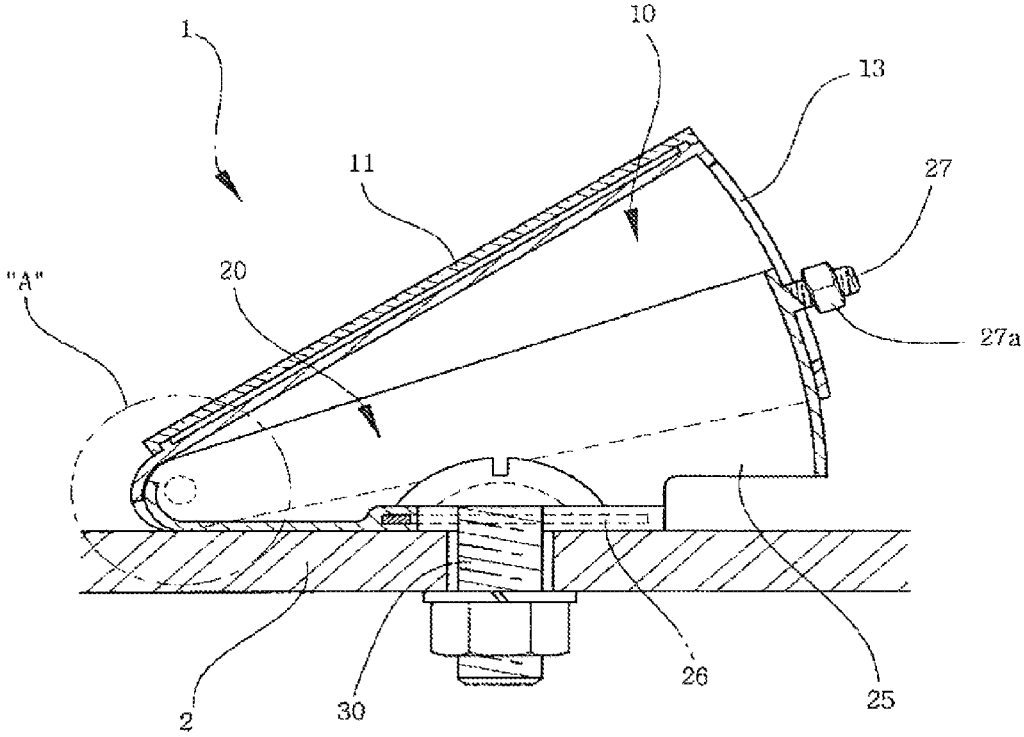
FIG. 2 is a cross-sectional view illustrating an installation state of the present invention.
Figure 5:
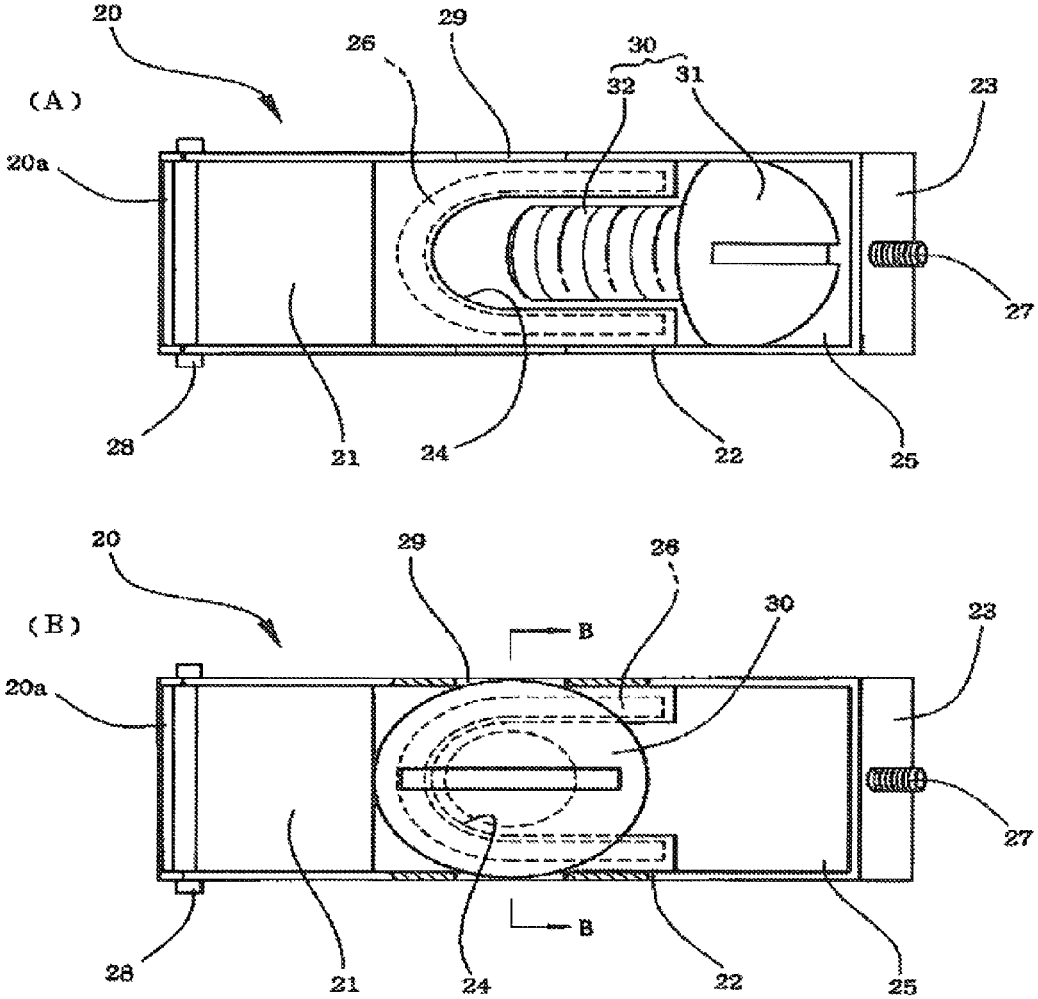
FIGS. 5A and 5B are plan views illustrating a structure of the present invention and an installation state of the anchor bolt.

As illustrated in FIGS. 1, 2, and 5, the present invention relates to a road delineator in which a hinged cover 10 including a reflector 11 attached to a top surface thereof covers an external side of a stationary body 20 installed at a road facility 2 by means of an anchor bolt 30 in a hinge-like manner such that a tilt angle of the hinged cover 10 is adjustable.

The stationary body 20 is shaped like a sectorial box with an opened top part and includes side plates 22 and a front plate 23 in both sides and a front side of a bottom plate 21, respectively. Further, the stationary body 20 is formed with a U-shaped cut-out portion 24, which includes a backing metal 26 embedded in the bottom plate 21 by an insert molding and is formed in such a manner that the front side thereof is open, and a bolt head insert 25 formed by tearing off a corner of the front lower side of the stationary body 20 to communicate with the U-shaped cut-out portion 24.

In this case, when the U-shaped cut-out portion 24 and the bolt head insert 25 are seen from the plan view, as illustrated in FIG. 5, the U-shaped cut-out portion 24 and the bolt head insert 25 are shaped like the letter "T", such that a head 31 of an anchor bolt 30 is inserted in the bolt head insert 25 and a bolt part 32 is inserted into the U-shaped cut-out portion 24.

Hinge protrusions 28 protrude outward from the outside surfaces of rear parts of the side plates 22, bolt head holding portions 29 to which both ends of the head 31 of the anchor bolt 30 are fitted and held are formed in the side plates 22 on the same central line as that of the bolt part 32 when the bolt part 32 is vertically installed inside the U-shaped cut-out portion 24, and a screw 27 protrudes from an external surface of an upper part of the front plate 23 of the stationary body 20.

Figure 6:
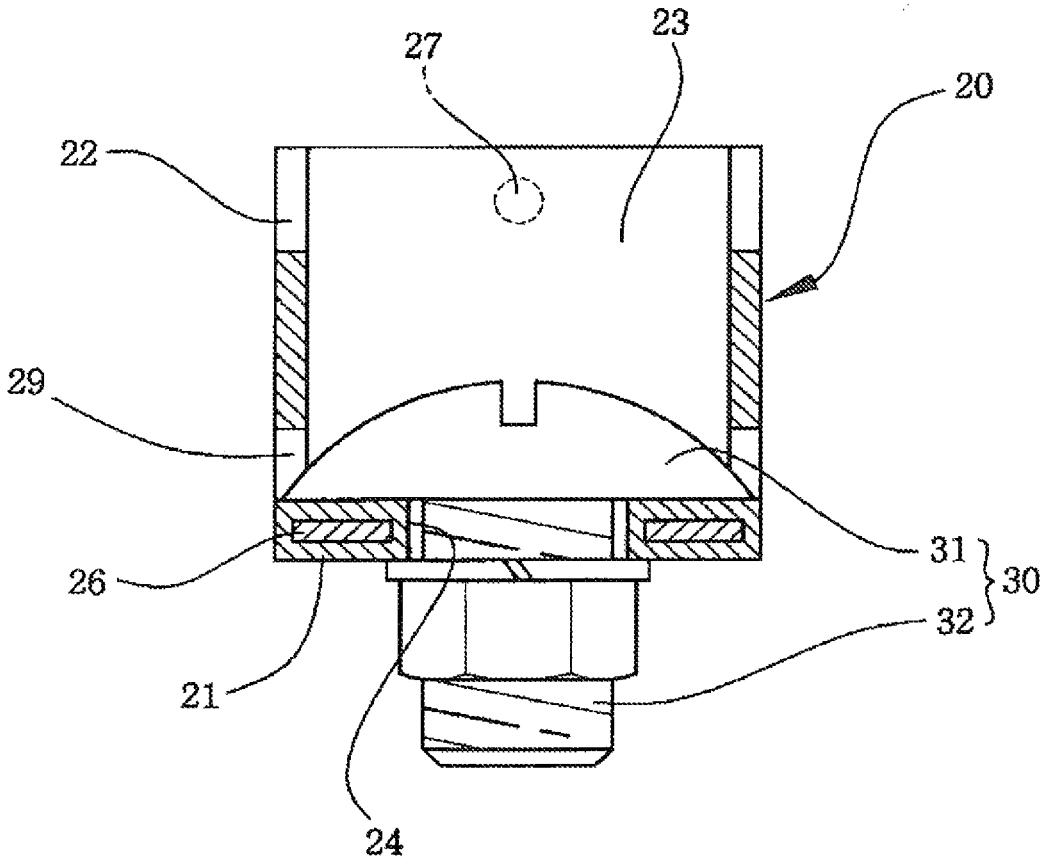
FIG. 6 is an enlarged cross-sectional view taken along line B-B of FIG. 5B.

In this case, it is preferable that the head 31 of the anchor bolt 30 has a round shape as illustrated in FIG. 6 so that the bolt head holding portion 29 is formed such that a lower part of the bolt head holding portion 29 is horizontal and an upper part of the bolt head holding portion 29 is shaped like an arc. Any bolt having a head shaped like a hexagon, quadrangle, or a plate, as well as a round head, may be applied to the present invention.

Further, the hinged cover 10 is shaped like a sectorial box with an opened bottom part so as to cover a top part of the stationary body 20 and includes the reflector 11 attached to the top surface thereof. Further, the hinged cover 10 is formed with hinge pin holes 12, to which hinge protrusions 28 of the stationary body 20 are fitted, in the rear hinge parts of the side plates and a vertically elongated slot 13, through which the screw 27 of the stationary body 20 passes, in the front plate thereof.

A locking nut 27*a* is fastened with the screw 27 protruding outward through the elongated slot 13 so that the hinged cover 10 is installed in such a manner that a tilt angle of the hinged cover 10 is adjusted based on the hinge protrusions 28 in the outside of the stationary body 20.

Further, a diameter of the head 31 of the anchor bolt 30 has a size large enough to be forcedly fitted between the side plates 22 of the stationary body 20, so that both sides of the head 31 are fitted to and held by the both-side bolt head holding portions 29.

Figure 3:
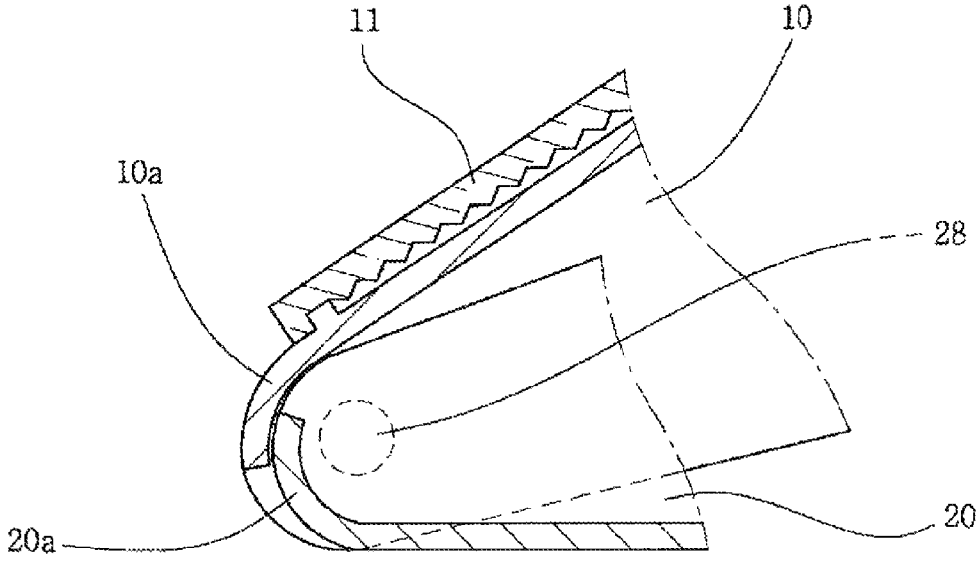
FIG. 3 is an enlarged partial cross-sectional view of part "A" of FIG. 2.

As illustrated in FIGS. 2 and 3, rear covers 10*a* and 20*a* at ends of the rear sides of the hinged cover 10 and the stationary body 20 are curved according to a round shape of the hinge part in the rear side of the hinged cover and the stationary body 20. The rear covers 10*a* and 20*a* are overlapped in such a manner that the rear cover 10*a* in the side of the hinged cover 10 surrounds the rear cover 20*a* in the side of the stationary body 20, such that foreign substances including rainwater are prevented from being introduced.

Figure 7:
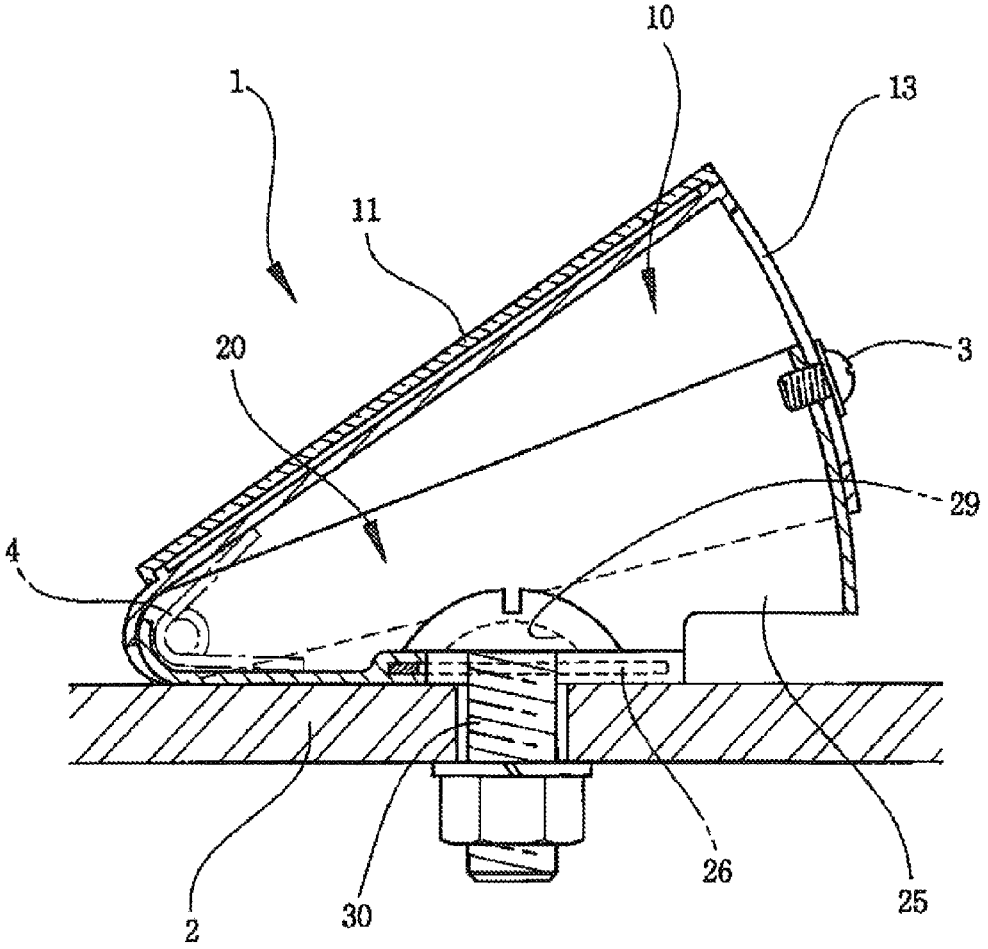
FIG. 7 is a cross-sectional view illustrating an installation state according to another embodiment of the present invention.

As illustrated in FIG. 7, contrary to the embodiment of FIGS. 1 and 2 in which the screw 27 is not formed in the front plate of the stationary body 20, a locking screw 3 is fastened through the elongated slot 13 of the hinged cover 10 so as to adjust the tilt angle of the hinged cover 10 in the outside of the stationary body 20, and a spring 4 may be mounted inside of the stationary body 20 and the hinged cover 10.

The operative relation of the present invention will be described with reference to FIGS. 1 to 6.

First, in assembling of the delineator 1 according to the present invention, as illustrated in FIGS. 1 and 2, in a state where the opened bottom part of the hinged cover 10 and the opened top part of the stationary body 20 face each other, the screw 27 protruding forward from the front plate 23 is inserted through the elongated slot 13 of the hinged cover 10 while inserting the front plate 23 of the stationary body 20 inside the front side of the hinged cover 10.

According to the insertion of the screw 27 from the inside to the outside of the hinged cover 10, the screw 27 enters a position of protruding outward from the elongated slot 13, and in this position, the hinge protrusions 28 protruding outward from the outside of the rear parts of the side plates 22 of the stationary body 20 are inserted through the hinge pin holes 12 formed in both rear sides of the hinged cover 10 from the inside to the outside of the hinge pin holes 12.

In this event, an entire distance from an end of one hinge protrusion 28 of the stationary body 20 to an end of the other hinge protrusion 28 of the stationary body 20 is larger than an inside width of the hinged cover 10, so that it is impossible to insert the rear part of the stationary body 20 inside the hinged cover 10 when the rear part of the stationary body 20 is formed with the outwardly protruding hinge protrusions 28 inside the hinged cover 10. However, since the hinged cover 10 and the stationary body 20 are injection molded with a synthetic resin material, they are elastic by a predetermined width, so that the hinge protrusions 28 in both sides of the stationary body 20 may be inserted through the hinge pin holes 12 of the hinged cover 10 through widening the rear internal sides of the hinged cover 10.

As such, the both-side hinge protrusions 28 of the stationary body 20 are inserted outward through the hinge pin holes 12 of the hinged cover 10 and the screw 27 is inserted outward through the elongated slot 13, so that the hinged cover 10 enters a position where the front side of the hinged cover 10 formed with the elongated slot 13 is movable up and down by a length of the elongated slot 13 about the hinge part in which the hinge protrusions 28 are coupled to the hinge pin holes 12.

In this position, when a locking nut 27*a* is engaged with the screw 27 protruding outward from the elongated slot 13, the hinged cover 10 is fixed in a tilted state at the engaged position.

Figure 4:
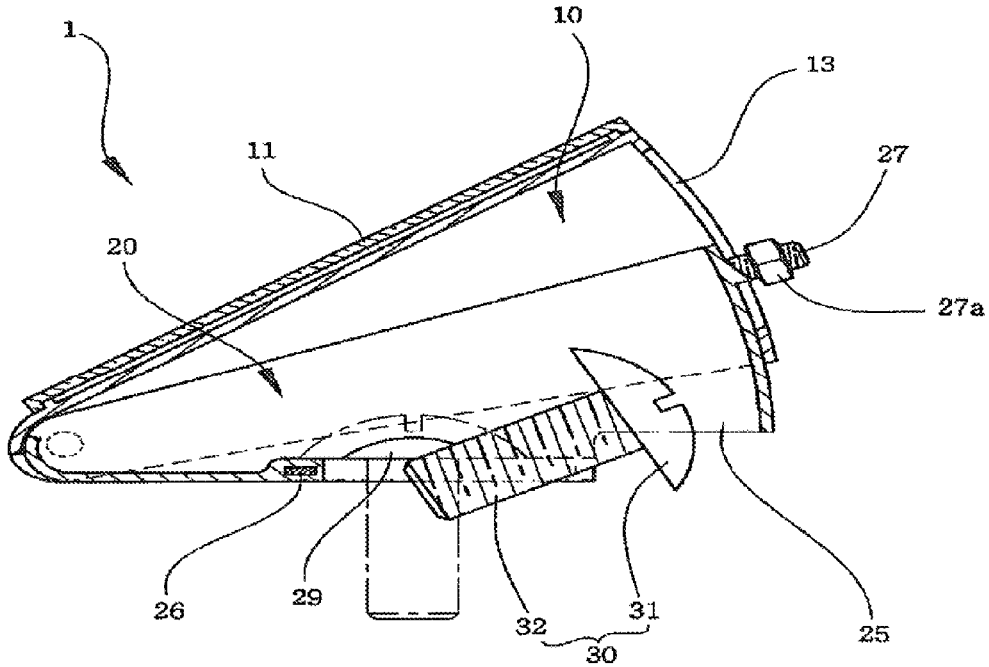
FIG. 4 is a cross-sectional view illustrating installation of an anchor bolt at a delineator according to the present invention.

Next, as illustrated in FIGS. 4 to 6, the anchor bolt 30 is fastened with the delineator 1 having the assembled hinged cover 10 and stationary body 20. In this case, as illustrated in FIGS. 4 and 5A, the head 31 of the anchor bolt 30 is first inserted upward into the bolt head insert 25 of the stationary body 20 while the anchor bolt 30 gets close to the lower side of the stationary body 20 in a laid state.

When the head 31 is inserted inside the bolt head insert 25, the head 31 is formed in a size large enough to be forcedly inserted into the inside width of the stationary body 20, so that both sides of the head 31 are tightly fitted to inside wall surfaces of the stationary body 20. However, since the stationary body 20 is made of a synthetic resin material and the upper and lower parts thereof through which the head 31 is inserted are open, the head 31 is inserted inside the stationary body 20 through forcedly widening the side plates 22.

The bolt part 32 approaches the inside U-shaped cut-out portion 24 while the anchor bolt 30 forcedly fitted to the inside stationary body 20 vertically stands as illustrated in FIG. 4. When a bottom surface of the head 31 is in contact with the bottom plate 21, both sides of the head 31 are fitted to the bolt head holding portions 29 formed in both sides of the side plates 22 as illustrated in FIGS. 5B and 6.

Since the diameter of the head 31 has a size large enough to be forcedly inserted into the inside width of the stationary body 20 as described above, both sides of the head 31 are fitted to the bolt head holding portions 29, so that the anchor bolt 30 engaged in the inside of the stationary body 20 is prevented from being shaken and its position is not changed to maintain the original position. Then, the assembling of the delineator 1 is completed.

In a case where the assembling completed delineator 1 is installed at the road facility 2 including a guardrail installed in a road, the bolt part 32 of the anchor bolt 30 protruding downward through the U-shaped cut-out portion 24 of the stationary body 20 is inserted through a bolt hole formed at the road facility 2 and a nut is fastened with the inserted bolt part 32, to conveniently complete the installation of the road facility 2.

Even in a case where the nut is strongly fastened when the nut is fastened with the bolt part 32 of the anchor bolt 30, a backing metal 26 formed in a U-shaped metal plate is embedded in the bottom plate 21 contacting the bottom surface of the head 31 by an insert molding, so that the bottom plate 21 of the stationary body 20 is prevented from being damaged.

In the meantime, the assembling and the installation of the present invention may be differently implemented from the aforementioned method. According to another installation method, the stationary body 20 may be installed at the road facility 2 by using the anchor bolt 30 in a state where the hinged cover 10 is separated from the stationary body 20 and then the hinged cover 10 may be assembled with the stationary body 20 installed at the road facility 2.

After the installation of the delineator 1 at the road facility 2 by any one method from the aforementioned two installation methods, an angle of the hinged cover 10 formed with the reflector 11 attached to the external top surface of the hinged cover 10 is adjusted in accordance with a degree of a curve of the road.

In a case where it is desired to adjust the angle of the hinged cover 10, when the locking nut 27*a* positioned in the outside of the elongated slot 13 is loosely released, a fastening force of the locking nut 27*a* is released, so that the hinged cover 10 can freely move up and down in a direction of the elongated slot 13 about the hinge part in which the hinge protrusions 28 are coupled to the hinge pin holes 12.

In this position, when the locking nut 27*a* is tightly fastened at a necessary position while adjusting the angle of the hinged cover 10 in accordance with the degree of the curve of the road, the hinged cover 10 is fixed at the fastened position by the fastening force of the locking nut 27*a*.

The tilt angle of the hinged cover 10 is adjusted as described above, so that the installation of the delineator 1 is completed. Accordingly, a driver driving on a winding road can accurately perceive the degree of the curve of the winding road, so that the delineator 1 is helpful in aiding safe driving.

The accurate perception of the winding road means that the driver can accurately see light from car headlights because the delineator 1 is installed in an angle adjusted in accordance with the circumstance of the road to accurately reflect the light from car headlights.

Further, the stationary body 20 and the hinged cover 10 of the delineator 1 are shaped like a sectorial box capable of covering each other, and the rear cover 10*a* overlapped with and surrounding the rear cover 20*a* and the rear cover 20*a* are formed in a round shape in the rear side of the hinge part of the stationary body 20 and the hinged cover 10 as illustrated in FIG. 3. As a result, the road delineator according to the present invention may minimize the introduction of foreign substances including rainwater through the space between the stationary body 20 and the hinged cover 10, to facilitate the smooth hinge operation of the hinged cover 10.

The invention claimed is:

1. A road delineator comprising:

a stationary body installed at a road facility by means of an anchor bolt; and a hinged cover formed with a reflector attached to a top surface thereof, the hinged cover covering an outside of the stationary body in a hinge-like manner such that an angle of inclination thereof is adjustable, wherein the stationary body is shaped like a sectorial box with an opened top part and comprises a U-shaped cut-out portion formed with a backing metal embedded in a bottom plate thereof and formed in such a manner that a front side thereof is open, a screw protruding from an external surface of an upper side of a front plate, a bolt head insert formed by tearing off a corner of a front lower side of the stationary body to communicate with the U-shaped cut-out portion, and bolt head holding portions into which both ends of a head of an anchor bolt are inserted to be held, the bolt head holding portions being formed at predetermined positions of both side plates, the hinged cover is shaped like a sectorial box with an opened bottom part, covers a top part of the stationary body, and is formed with an elongated slot through which the screw of the stationary body is inserted and guided up and down at a front plate thereof, and a locking nut is fastened with the screw protruding outward from the elongated slot, and a diameter of the head of the anchor bolt is formed in a size large enough to be forcedly fitted between the side plates of the stationary body such that both sides of the head are fitted to and held by the bolt head holding portions in both sides of the stationary body.

2. The road delineator as claimed in claim 1, wherein round and curved rear covers and are formed at rear side ends of the hinged cover and the stationary body while being overlapped with each other, to prevent introduction of rainwater.

* * * * *